US010883062B2

(12) United States Patent
Aoki et al.

(10) Patent No.: US 10,883,062 B2
(45) Date of Patent: Jan. 5, 2021

(54) MINERAL OIL-BASED BASE OIL, LUBRICATING OIL COMPOSITION, EQUIPMENT, LUBRICATING METHOD, AND GREASE COMPOSITION

(71) Applicant: IDEMITSU KOSAN CO., LTD., Chiyoda-ku (JP)

(72) Inventors: Shinji Aoki, Sodegaura (JP); Moritsugu Kasai, Chiba (JP); Asami Koga, Chiba (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 16/088,654

(22) PCT Filed: Dec. 14, 2016

(86) PCT No.: PCT/JP2016/087297
§ 371 (c)(1),
(2) Date: Sep. 26, 2018

(87) PCT Pub. No.: WO2017/168868
PCT Pub. Date: Oct. 5, 2017

(65) Prior Publication Data

US 2019/0106645 A1 Apr. 11, 2019

(30) Foreign Application Priority Data

Mar. 31, 2016 (JP) ..... 2016-073059

(51) Int. Cl.

| | |
|---|---|
| ***C10M 171/02*** | (2006.01) |
| ***C10M 115/08*** | (2006.01) |
| ***C10M 117/04*** | (2006.01) |
| ***C10M 169/02*** | (2006.01) |
| ***C10M 101/02*** | (2006.01) |
| *C10N 20/02* | (2006.01) |
| *C10N 20/00* | (2006.01) |
| *C10N 30/02* | (2006.01) |
| *C10N 30/06* | (2006.01) |
| *C10N 30/00* | (2006.01) |
| *C10N 40/08* | (2006.01) |
| *C10N 40/20* | (2006.01) |
| *C10N 40/30* | (2006.01) |
| *C10N 50/10* | (2006.01) |

(52) U.S. Cl.

CPC ..... *C10M 101/025* (2013.01); *C10M 101/02* (2013.01); *C10M 115/08* (2013.01); *C10M 117/04* (2013.01); *C10M 169/02* (2013.01); *C10M 171/02* (2013.01); *C10M 2203/1006* (2013.01); *C10M 2203/1025* (2013.01); *C10M 2207/026* (2013.01); *C10M 2207/1285* (2013.01); *C10M 2215/064* (2013.01); *C10M 2215/065* (2013.01); *C10M 2215/223* (2013.01); *C10M 2215/28* (2013.01); *C10M 2217/0456* (2013.01); *C10M 2219/106* (2013.01); *C10M 2223/02* (2013.01); *C10N 2020/02* (2013.01); *C10N 2020/065* (2020.05); *C10N 2020/069* (2020.05); *C10N 2020/071* (2020.05); *C10N 2030/02* (2013.01); *C10N 2030/06* (2013.01); *C10N 2030/43* (2020.05); *C10N 2040/08* (2013.01); *C10N 2040/20* (2013.01); *C10N 2040/30* (2013.01); *C10N 2050/10* (2013.01)

(58) Field of Classification Search

CPC ..... C10N 2240/40; C10N 2230/02; C10N 2230/43; C10N 2250/10; C10N 2240/30; C10N 2240/08; C10N 2010/02; C10N 2020/02; C10N 2040/02; C10M 2203/1006; C10M 2207/1285; C10M 2215/28

See application file for complete search history.

(56) References Cited

U.S. PATENT DOCUMENTS

| | | | | |
|---|---|---|---|---|
| 5,135,638 | A | 8/1992 | Miller | |
| 5,246,566 | A | 9/1993 | Miller | |
| 2005/0133408 | A1 | 6/2005 | Abernathy et al. | |
| 2005/0133409 | A1 | 6/2005 | Abernathy et al. | |
| 2007/0037716 | A1* | 2/2007 | Tamoto | C10M 105/38 508/506 |
| 2007/0142250 | A1 | 6/2007 | Loh et al. | |
| 2010/0035777 | A1 | 2/2010 | Sano et al. | |
| 2011/0046027 | A1* | 2/2011 | Zhamu | C10M 103/02 508/113 |
| 2011/0230685 | A1 | 9/2011 | Tagawa | |
| 2014/0329730 | A1 | 11/2014 | Watanabe et al. | |
| 2015/0368569 | A1 | 12/2015 | Hayasaka et al. | |

FOREIGN PATENT DOCUMENTS

| | | | |
|---|---|---|---|
| JP | 4-503371 | A | 6/1992 |
| JP | 5-504597 | A | 7/1993 |
| JP | 2002-528559 | A | 9/2002 |
| JP | 2007-516338 | A | 6/2007 |
| JP | 2010-90251 | A | 4/2010 |

(Continued)

OTHER PUBLICATIONS

International Search Report dated Feb. 14, 2017, in PCT/JP2016/087297, filed Dec. 14, 2016.

(Continued)

*Primary Examiner* — Vishal V Vasisth

(74) *Attorney, Agent, or Firm* — Oblon, McClelland, Maier & Neustadt, L.L.P.

(57) ABSTRACT

The present invention provides a mineral base oil having a kinetic viscosity at 100° C. of 7 $mm^2/s$ or more and less than 10 $mm^2/s$, a viscosity index of 100 or more, and a temperature gradient $\Delta|\eta^*|$ complex viscosity between two temperature points of −5° C. and −15° C. of 240 mPa·s/° C. or less as measured with a rotary rheometer at an angular velocity of 6.3 rad/s. The use of the mineral base oil enables easy preparation of a lubricating oil composition and a grease composition having excellent oxidation stability while ensuring the freedom of selection of additives.

6 Claims, No Drawings

(56) References Cited

FOREIGN PATENT DOCUMENTS

| | | | |
|---|---|---|---|
| JP | 2014-515058 | A | 6/2014 |
| JP | 6047224 | B1 | 12/2016 |
| WO | WO 2005/066319 | A1 | 7/2005 |
| WO | WO 2010/069984 | A1 | 6/2010 |
| WO | WO 2014/125683 | A1 | 8/2014 |

OTHER PUBLICATIONS

Extended European Search Report dated Oct. 2, 2019 in European Patent Application No. 16897084.6, 7 pages.
Office Action dated Sep. 8, 2020 in Japanese Patent Application No. 2018-508389 (w/ computer-generated English translation).
Office Action dated Oct. 27, 2020, in European Patent Application No. 16897084.6.

* cited by examiner

MINERAL OIL-BASED BASE OIL, LUBRICATING OIL COMPOSITION, EQUIPMENT, LUBRICATING METHOD, AND GREASE COMPOSITION

This application is a 371 of PCT/JP2016/087297, filed Dec. 14, 2016.

FIELD OF INVENTION

The present invention relates to a mineral base oil, a lubricating oil composition containing the mineral base oil, an instrument and a lubricating method using the lubricating oil composition, and a grease composition containing the mineral base oil.

BACKGROUND ART

Lubricating oil compositions used in turbines, such as steam turbines and gas turbines, and instruments, such as rotational gas compressors, hydraulic instruments, and machine tools are used while circulating in a system in a high temperature environment for a long period of time, and thus the antioxidant performance is gradually reduced, thereby increasing possibility of causing malfunction of the instrument.

Lubricating oil compositions used in such instruments are required to have excellent oxidation stability even in use in a high temperature environment for a long period of time.

As one means for obtaining a lubricating oil composition that has increased oxidation stability and that can be suitably used in turbines, rotational gas compressors, hydraulic instruments, machine tools, and the like, optimization of combination of various additives has been studied.

For example, PTL 1 discloses a lubricating oil composition containing a base oil, an aromatic amine antioxidant, and a dithiocarbamate anti-wear agent, the respective contents of the aromatic amine antioxidant and the dithiocarbamate anti-wear agent and the total content thereof being adjusted in specific ranges.

PTL 2 discloses a lubricating oil composition containing a combination of unsubstituted phenylnaphthylamine and a di(alkylphenyl)amine as an antioxidant, and containing a thiophosphate as an anti-wear agent.

The lubricating oil compositions disclosed in PTLs 1 and 2 aims at an effect of synergistically increasing antioxidant performance by incorporating an aromatic amine antioxidant which is an antioxidant and a sulfur atom-containing compound which is an anti-wear agent in combination.

CITATION LIST

Patent Literature

PTL 1: JP 2014-515058 A
PTL 2: JP 2002-528559 A

SUMMARY OF INVENTION

Technical Problem

However, since the lubricating oil compositions disclosed in PTLs 1 and 2 contain a sulfur atom-containing compound, sludge formation is likely to be induced with the use particularly under a high temperature environment.

Formed sludge may often, for example, adhere on a bearing of a rotor to generate heat and damage the bearing, cause clogging of a filter in a circulation line, and deposit on a control valve to cause malfunction of a control system and the like.

Various additives for lubricating oil blended in lubricating oil compositions are appropriately selected and used, in combination of two or more as needed, for improving characteristics according to the application.

In lubricating oil compositions that are intended to have improved oxidation stability through a specific combination of additives for lubricating oil as disclosed in PTLs 1 and 2, the specific combination of additives for lubricating oil which contributes to improvement of the oxidation stability can not be changed, and the degree of freedom in selection of additives for lubricating oil is limited. Variation in formulation of certain additives for lubricating oil in order to improve characteristics other than oxidation stability may not be possible in some cases.

The same problem is present not only in lubricating oil compositions but also in grease compositions.

The present invention has an object to provide a lubricating oil composition and a grease having excellent oxidation stability while ensuring the freedom of selection of additives.

Solution to Problem

For improving oxidation stability of a lubricating oil composition and a grease composition, the present inventors focused on a base oil contained in the lubricating oil composition.

The present inventors have thus found that the above problem can be solved by a mineral base oil that has a specific kinetic viscosity and a specific viscosity index, as well as an adjusted temperature gradient $\Delta|\eta^*|$ of complex viscosity between two temperature points of −5° C. and −15° C. to a specific value or less. The temperature gradient $\Delta|\eta^*|$ of complex viscosity between two temperature points of −5° C. and −15° C. here is a measure comprehensively indicating a balance of various characteristics (for example, a ratio of branched-chain isoparaffins and straight-chain paraffins contained; contents of an aromatic component, a sulfur component, a nitrogen component, and a naphthene component; a refinement state of the mineral base oil) about various components constituting the mineral base oil.

Specifically, the present invention provides the following [1] to [5].

[1] A mineral base oil having:

a kinetic viscosity at 100° C. of 7 $mm^2/s$ or more and less than 10 $mm^2/s$;

a viscosity index of 100 or more; and a temperature gradient $\Delta|\eta^*|$ of complex viscosity between two temperature points of −5° C. and −15° C. of 240 mPa·s/° C. or less as measured with a rotary rheometer at an angular velocity of 6.3 rad/s.

[2] A lubricating oil composition containing the mineral base oil of the above [1].

[3] An instrument, which is selected from a turbomachine, a compressor, a hydraulic instrument, and a machine tool, the instrument using the lubricating oil composition of the above [2].

[4] A lubricating method, including using the lubricating oil composition of the above [2] for an instrument selected from a turbomachine, a compressor, a hydraulic instrument, and a machine tool.

[5] A grease composition containing the mineral base oil of the above [1] and a thickener.

Advantageous Effects of Invention

The use of the mineral base oil of the present invention enables preparation of a lubricating oil composition and a grease composition having excellent oxidation stability while ensuring the freedom of selection of additives.

DESCRIPTION OF EMBODIMENTS

As used herein, a kinetic viscosity and a viscosity index at a prescribed temperature mean values measured according to JIS K2283:2000.

As used herein, a complex viscosity $\eta^*$ at a prescribed temperature means a value measured with a rotary rheometer at an angular velocity of 6.3 rad/s, and more specifically means a value measured according to a method described later in Examples.

In the measurement of a complex viscosity $\eta^*$ of with a rotary rheometer, a "strain amount" is appropriately set according to the measurement temperature, and, for example, in Examples described later, it is set to "3.4 to 3.5%" in measurements at −5° C. and "1.1%" in measurements at −15° C.

[Mineral Base Oil]

Examples of the mineral base oils of the present invention include a topped crude obtained by atmospheric distillation of a crude oil, such as a paraffinic mineral oil, an intermediate mineral oil, or a naphthenic mineral oil; a distillate oil obtained by vacuum distillation of the topped crude; and a mineral oil or a wax (e.g., GTL wax) obtained by subjecting the distillate oil to one or more of refining processes, such as solvent deasphalting, solvent extraction, hydrofinishing, solvent dewaxing, catalytic dewaxing, isomerization dewaxing, and vacuum distillation.

These mineral oils may be used either alone or in combination of two or more thereof.

The mineral base oil of the present invention satisfies the following Requirements (I) to (III).

Requirement (I): a kinetic viscosity at 100° C. is 7 $mm^2/s$ or more and less than 10 $mm^2/s$.

Requirement (II): a viscosity index is 100 or more.

Requirement (III): a temperature gradient $\Delta|\eta^*|$ of complex viscosity between two temperature points of −5° C. and −15° C. is 240 mPa·s/° C. or less as measured with a rotary rheometer at an angular velocity of 6.3 rad/s.

The mineral base oil of one embodiment of the present invention preferably further satisfies the following Requirement (IV).

Requirement (IV): a complex viscosity $\eta^*$ at −15° C. is 3,000 mPa·s or less as measured with a rotary rheometer at an angular velocity of 6.3 rad/s.

In the case where the mineral base oil of one embodiment of the present invention is a mixed oil of two or more mineral oils, it is enough that the mixed oil satisfies the aforementioned Requirements.

Requirements (I) to (IV) will be explained below.

<Requirement (I)>

Requirement (I) defines a balance between vaporization loss and fuel consumption improving effect of the mineral base oil.

Specifically, when the mineral base oil of the present invention has a kinetic viscosity at 100° C. less than 7 $mm^2/s$, the thickness of the oil film is reduced, possibly resulting in increased abrasion loss. On the other hand, a kinetic viscosity at 100° C. of 10 $mm^2/s$ or more may lead to increased energy loss.

From the viewpoint of increasing the oil film thickness, the kinetic viscosity at 100° C. of the mineral base oil of one embodiment of the present invention is preferably 7.1 $mm^2/s$ or more, more preferably 7.2 $mm^2/s$ or more, and further preferably 7.3 $mm^2/s$ or more, and from the viewpoint of suppression of energy loss to save the energy, preferably 9.9 $mm^2/s$ or less, more preferably 9.8 $mm^2/s$ or less, and further preferably 9.6 $mm^2/s$ or less.

<Requirement (II)>

Requirement (II) is a definition for providing a mineral base oil having low temperature dependence of viscosity.

Specifically, when the mineral base oil of the present invention has a viscosity index less than 100, there is a problem in that variation in viscosity by the temperature environment is large and a lubricating oil composition including the mineral base oil does not have consistent performance.

From the above viewpoints, the viscosity index of the mineral base oil of one embodiment of the present invention is preferably 110 or more, more preferably 120 or more, and further preferably 130 or more, and it is generally 160 or less.

<Requirement (III)>

As defined in Requirement (III), the mineral base oil of the present invention is required to have a temperature gradient $\Delta|\eta^*|$ of complex viscosity between two temperature points of −5° C. and −15° C. (unless otherwise specified, hereinafter also referred to simply as "temperature gradient $\Delta|\eta^*|$ of complex viscosity") of 240 mPa·s/° C. or less as measured with a rotary rheometer at an angular velocity of 6.3 rad/s.

The aforementioned "temperature gradient $\Delta|\eta^*|$ of complex viscosity" is a value indicative of an amount of change (absolute value of a slope) of complex viscosity per unit between two temperature points −5° C. and −15° C. as observed when the value of the complex viscosity $\eta^*$ at −5° C. and the value of the complex viscosity $\eta^*$ at −15° C. as measured either independently at these temperatures or while continuously varying the temperature from −5° C. to −15° C. or from −15° C. to −5° C. are placed on a temperature-complex viscosity coordinate plane. More specifically, the temperature gradient $\Delta|\eta^*|$ of complex viscosity means a value calculated from the following calculation formula (f1).

Temperature gradient $\Delta|\eta^*|$ of complex viscosity=|([Complex viscosity $\eta^*$ at −15° C.]−[Complex viscosity $\eta^*$ at −5° C.])/(−15−(−5))| ] Calculation formula (f1):

The "temperature gradient $\Delta|\eta^*|$ of complex viscosity" defined in Requirement (III) is a measure comprehensively indicating a balance of various characteristics (for example, a ratio of branched-chain isoparaffins and straight-chain paraffins contained; contents of an aromatic component, a sulfur component, a nitrogen component, a naphthene component, and the like; a refinement state of the mineral base oil) about various components constituting the mineral base oil, which may have an influence on the oxidation stability of the mineral base oil.

For example, mineral oil contains a wax component and thus, when the temperature of a mineral oil is gradually decreased, the wax component in the mineral oil precipitates to form a gel-like structure. The wax component contains paraffins, naphthenes, and the like, and the precipitation rate of the wax component depends on the structures and the contents of such constituents.

According to studies of the present inventors, for example, the following tendency has been found: a wax component containing a larger amount of straight-chain paraffins (normal paraffins) has a higher precipitation rate and a larger value of temperature gradient $\Delta|\eta^*|$ of complex viscosity, whereas a wax component containing a larger amount of branched-chain isoparaffins has a lower precipitation rate and a smaller value of temperature gradient $\Delta|\eta^*|$ of complex viscosity.

The present inventors thought that, for example, a mineral oil having a wax component with a lower precipitation rate has higher oxidation stability of the mineral oil itself, and that when the mineral oil is used to produce a lubricating oil composition with an antioxidant further added, the antioxidant performance of the antioxidant added can be greatly increased as compared with the cases where existing mineral oils are used.

A mineral base oil having a larger value of temperature gradient $\Delta|\eta^*|$ of complex viscosity as defined in Requirement (III) tends to have a larger aromatic content and a larger sulfur content. The presence of the aromatic component and a sulfur component is likely to be a factor of sludge formation with the use.

Thus, a mineral base oil that has a value of temperature gradient $\Delta|\eta^*|$ of complex viscosity adjusted to satisfy Requirement (III) is likely to suppress sludge formation with the use and thus is excellent in oxidation stability.

On other words, in the mineral base oil satisfying Requirement (III), since characteristics about various components that may have an influence on the oxidation stability are comprehensively adjusted, the mineral base oil itself has high oxidation stability. In addition, the following effect is also likely to be exhibited: when the mineral base oil is used to produce a lubricating oil composition with an antioxidant added, the antioxidant performance of the added antioxidant can be greatly increased.

From the above viewpoint, in the mineral base oil of one embodiment of the present invention, the temperature gradient $\Delta|\eta^*|$ of complex viscosity as defined in Requirement (III) is preferably 220 mPa·s/° C. or less, more preferably 210 mPa·s/° C. or less, further preferably 200 mPa·s/° C. or less, furthermore preferably 190 mPa·s/° C. or less, and particularly preferably 170 mPa·s/° C. or less.

In the mineral base oil of one embodiment of the present invention, the temperature gradient $\Delta|\eta^*|$ of complex viscosity as defined in Requirement (III) is preferably 0.1 mPa·s/° C. or more, more preferably 1 mPa·s/° C. or more, further preferably 5 mPa·s/° C. or more, and furthermore preferably 10 mPa·s/° C. or more.

<Requirement (IV)>

A mineral base oil having a lower complex viscosity $\eta^*$ at −15° C. as defined in Requirement (IV) tends to have a lower proportion of straight-chain paraffins and itself have higher oxidation stability. Thus, the following effect is likely to be exhibited: when the mineral base oil is used to produce a lubricating oil composition with an antioxidant further added, the antioxidant performance of the added antioxidant can be greatly increased as compared with the cases where existing mineral oils are used.

From the above viewpoint, in the mineral base oil of one embodiment of the present invention, the complex viscosity $\eta^*$ at −15° C. as defined in Requirement (IV) is preferably 3,000 mPa·s or less, more preferably 2700 mPa·s or less, further preferably 2,500 mPa·s or less, furthermore preferably 2,300 mPa·s or less, and particularly preferably 1,900 mPa·s or less.

The complex viscosity $\eta^*$ at −15° C. as defined in Requirement (IV) has no particular lower limitation, but is preferably 50 mPa·s or more, more preferably 100 mPa·s or more, and further preferably 200 mPa·s or more.

The mineral base oil of one embodiment of the present invention has a naphthene content (% $C_N$) of preferably 10 to 30, more preferably 13 to 30, and further preferably 16 to 30.

When the mineral base oil has a naphthene content in the above range, sludge formed with the use can be dissolved to prevent the problem due to sludge.

The mineral base oil of one embodiment of the present invention preferably has an aromatic content (% $C_A$) of less than 1.0, and more preferably 0.1 or less from the viewpoint of reducing the possible amount of sludge formed.

As used herein, a naphthene content (% $C_N$) and an aromatic content (% $C_A$) of a mineral base oil respectively mean proportions (percentages) of a naphthene component and an aromatic component measured according to ASTM D-3238 ring analysis (n-d-M method).

The mineral base oil of one embodiment of the present invention preferably has a sulfur component of less than 10 ppm by mass from the viewpoint of providing a mineral base oil that can produce a lubricating oil composition suppressed in sludge formation.

As used herein, a sulfur content of a mineral base oil means a value measured according to JIS K2541-6:2003 "Crude oil and petroleum product—sulfur content test method".

From the viewpoint of increasing the oxidation stability of the mineral base oil itself, and also providing a mineral base oil that can allow an antioxidant, when added, to effectively exhibit the antioxidant performance, the mineral base oil of one embodiment of the present invention has a nitrogen content of preferably less than 100 ppm by mass, more preferably less than 10 ppm by mass, and further preferably less than 1 ppm by mass.

A nitrogen content of a mineral base oil means a value measured according to JIS K2609:1998 4.

From the viewpoint of providing a mineral base oil that can produce a lubricating oil composition having excellent high-temperature piston detergency, the mineral base oil of one embodiment of the present invention preferably has an aromatic content (% $C_A$) of 0.1 or less and a sulfur content of less than 10 ppm by mass.

<Preparation Example of Mineral Base Oil Satisfying Requirements (I) to (IV)>

A mineral base oil that satisfies the aforementioned Requirements (I) to (IV), particularly Requirements (III) and (IV), can be readily prepared, for example, in view of the following matters. The following matters represent one example of the preparation method and such a mineral base oil can be prepared by taking into account other matters.

(1) Selection of Feedstock Oil as Raw Material of Mineral Base Oil

The mineral base oil of one embodiment of the present invention is preferably obtained by refining a feedstock oil.

From the viewpoint of producing a mineral base oil satisfying the aforementioned Requirements (I) to (IV), in particular, Requirements (III) and (IV), the feedstock oil is preferably one containing a petroleum-derived wax, and one containing a petroleum-derived wax and a bottom oil. A feedstock oil containing a solvent-dewaxed oil may also be used.

When a feedstock oil containing a petroleum-derived wax and a bottom oil is used, the ratio of the wax content to the bottom oil content [wax/bottom oil] by mass in the feedstock oil is preferably 30/70 to 98/2, more preferably 55/45 to 97/3, further preferably 70/30 to 96/4, and furthermore preferably 80/20 to 95/5 from the viewpoint of producing a mineral base oil satisfying Requirements (III) and (IV).

An increased proportion of the bottom oil in the feedstock oil tends to lead to an increased value of temperature gradient $\Delta|\eta^*|$ of complex viscosity as defined in Requirement (III), and is also likely to lead to an increased value of complex viscosity $\eta^*$ at −15° C. as defined in Requirement (IV).

An example of bottom oils is a bottom fraction which, in a common fuel oil production process using a crude oil as a raw material, remains after hydrogenating an oil containing a heavy fuel oil obtained from vacuum distillation apparatus and separating off naphtha and kerosene-gas oil.

Examples of waxes include: a wax separated through solvent dewaxing of the aforementioned bottom fraction; a wax obtained by subjecting a topped crude remaining after atmospheric distillation of a crude oil, such as a paraffinic mineral oil, an intermediate mineral oil, and a naphthenic mineral oil, to separate off naphtha and kerosene-gas oil to solvent dewaxing; a wax obtained by subjecting a distillate oil obtained through vacuum distillation of the topped crude to solvent dewaxing; a wax obtained by subjecting an oil obtained through solvent deasphalting, solvent extraction, and hydrofinishing of the distillate oil to solvent dewaxing; and a GTL wax obtained by the Fischer-Tropsch synthesis.

On the other hand, an example of solvent-dewaxed oils is a residue remaining after solvent dewaxing of the bottom fraction or the like to separate off the wax. The solvent-dewaxed oil, which has been subjected to a refining process of solvent dewaxing, differs from the aforementioned bottom oil.

A preferred example of methods for obtaining a wax through solvent dewaxing is a method in which a bottom fraction is mixed with a mixed solvent of methyl ethyl ketone and toluene, and while the mixture is stirred in a low temperature region, precipitation is removed to obtain the wax.

From the viewpoint of producing a mineral base oil satisfying Requirements (III) and (IV), a specific temperature in the low temperature environment in the solvent dewaxing is preferably lower than a temperature in a common solvent dewaxing, and specifically preferably −25° C. or less, and more preferably −30° C. or less.

From the viewpoint of producing a mineral base oil satisfying Requirements (III) and (IV), the feedstock oil preferably has an oil content of 5 to 55% by mass, more preferably 7 to 45% by mass, further preferably 10 to 35% by mass, furthermore preferably 13 to 32% by mass, and particularly preferably 15 to 25% by mass.

From the viewpoint of producing a mineral base oil satisfying Requirement (I), the feedstock oil preferably has a kinetic viscosity at 100° C. of 2.5 to 12.0 $mm^2/s$, more preferably 3.0 to 11.0 $mm^2/s$, and further preferably 3.5 to 10.0 $mm^2/s$.

From the viewpoint of producing a mineral base oil satisfying Requirement (II), the feedstock oil preferably has a viscosity index of 100 or more, more preferably 110 or more, and further preferably 120 or more, and it is generally 200 or less.

(2) Setting of Refining Conditions of Feedstock Oil

The mineral base oil of one embodiment of the present invention is preferably obtained by refining a feedstock oil containing a petroleum-derived wax, and more preferably obtained by refining the aforementioned feedstock oil containing a petroleum-derived wax and a bottom oil.

The feedstock oil is preferably subjected to a refining process to prepare a mineral base oil satisfying the aforementioned Requirements (I) to (IV).

The refining process preferably includes at least one of a hydrogenation isomerization dewaxing process and a hydrogenation process. Preferably, the type of the refining process and the refining conditions are appropriately set according to the type of the feedstock oil to be used.

More specifically, from the viewpoint of producing a mineral base oil satisfying Requirements (III) and (IV), the refining process is preferably selected as follows according to the type of the feedstock oil used.

When a feedstock oil (α) having the aforementioned ratio of a petroleum-derived wax content to a bottom oil content is used, a refining process including both of a hydrogenation isomerization dewaxing process and a hydrogenation process is preferably applied to the feedstock oil (α).

When a feedstock oil (ß) containing a solvent-dewaxed oil is used, it is preferred that a hydrogenation isomerization dewaxing process is not applied and a refining process including a hydrogenation process is applied, to the feedstock oil (ß).

The feedstock oil (α) contains a bottom oil, and thus tends to have a higher aromatic content, a higher sulfur content, and a higher nitrogen content. The presence of an aromatic component, a sulfur component, and a nitrogen component is likely to be a factor of sludge formation in a lubricating oil composition when produced.

The hydrogenation isomerization dewaxing process can remove an aromatic component, a sulfur component, and a nitrogen component to decrease the contents thereof.

The hydrogenation isomerization dewaxing process can convert straight-chain paraffins in a wax to branched-chain isoparaffins to thereby produce a mineral base oil satisfying Requirements (III) and (IV).

On the other hand, although the feedstock oil (ß) contains a wax, straight-chain paraffins are separated off by being precipitated under a low temperature environment through a solvent dewaxing process, and thus has a low content of straight-chain paraffins which have an influence on the value of the complex viscosity as defined in Requirements (III) and (IV). Thus, the "hydrogenation isomerization dewaxing process" is not required.

(Hydrogenation Isomerization Dewaxing Process)

The hydrogenation isomerization dewaxing process is a refining process performed for the purpose of isomerization of straight-chain paraffins contained in a feedstock oil to branched-chain isoparaffins, ring-opening of an aromatic component to convert it to a paraffin component, removal of impurities such as a sulfur component and a nitrogen component, and so on, as mentioned above.

In particular, the presence of straight-chain paraffins is one of the factors of increasing the value of temperature gradient $\Delta|\eta^*|$ of complex viscosity as defined in Requirement (III). Thus, in this process, straight-chain paraffins are isomerized to branched-chain isoparaffins to adjust the temperature gradient $\Delta|\eta^*|$ of complex viscosity to a low value.

The hydrogenation isomerization dewaxing process is preferably carried out in the presence of a hydrogenation isomerization dewaxing catalyst.

Examples of hydrogenation isomerization dewaxing catalysts include catalysts with metal oxides, such as oxides of nickel (Ni)/tungsten (W), nickel (Ni)/molybdenum (Mo), and cobalt (Co)/molybdenum (Mo), or noble metals, such as platinum (Pt) and lead (Pd), supported on carriers, such as silicoaluminophosphate (SAPO) and zeolite.

From the viewpoint of producing a mineral base oil satisfying Requirements (III) and (IV), the hydrogen partial pressure in the hydrogenation isomerization dewaxing process is preferably 2.0 to 220 MPa, more preferably 2.5 to 100 MPa, further preferably 3.0 to 50 MPa, and furthermore preferably 3.5 to 25 MPa.

From the viewpoint of producing a mineral base oil satisfying Requirements (III) and (IV), the reaction temperature in the hydrogenation isomerization dewaxing process is preferably set to a temperature higher than a reaction temperature of a common hydrogenation isomerization dewaxing process, and specifically is preferably 320 to 480° C., more preferably 325 to 420° C., further preferably 330 to 400° C., and furthermore preferably 340 to 370° C.

At a high reaction temperature, the isomerization of straight-chain paraffins into branched-chain isoparaffins can be promoted, whereby it is easy to prepare a mineral base oil satisfying Requirements (III) and (IV).

From the viewpoint of producing a mineral base oil satisfying Requirements (III) and (IV), the liquid hourly space velocity (LHSV) in the hydrogenation isomerization dewaxing process is preferably 5.0 $hr^{-1}$ or less, more preferably 2.0 $hr^{-1}$ or less, further preferably 1.0 $hr^{-1}$ or less, and furthermore preferably 0.6 $hr^{-1}$ or less.

From the viewpoint of increasing the productivity, the LHSV in the hydrogenation isomerization dewaxing process is preferably 0.1 $hr^{-1}$ or more, and more preferably 0.2 $hr^{-1}$ or more.

The supply proportion of the hydrogen gas in the hydrogenation isomerization dewaxing process is preferably 100 to 1000 $Nm^3$, more preferably 200 to 800 $Nm^3$, and further preferably 250 to 650 $Nm^3$ per kiloliter of the supplied feedstock oil.

The oil produced after the hydrogenation isomerization dewaxing process may be subjected to vacuum distillation to remove a light fraction.

(Hydrogenation Process)

The hydrogenation process is a refining process that is performed for purposes of complete saturation of an aromatic component contained in the feedstock oil, removal of impurities, such as a sulfur component and a nitrogen component, and so on.

The hydrogenation process preferably carried out in the presence of a hydrogenation catalyst.

Examples of hydrogenation catalysts include catalysts with metal oxides, such as oxides of nickel (Ni)/tungsten (W), nickel (Ni)/molybdenum (Mo), and cobalt (Co)/molybdenum (Mo), or noble metals, such as platinum (Pt) and lead (Pd), supported on amorphous carriers, such as silica/alumina and alumina, or crystalline carriers, such as zeolite.

From the viewpoint of producing a mineral base oil satisfying Requirements (III) and (IV), the hydrogen partial pressure in the hydrogenation process is preferably set to a value higher than a pressure in a common hydrogenation process, and specifically is preferably 16 MPa or more, more preferably 17 MPa or more, and further preferably 20 MPa or more, and it is preferably 30 MPa or less, and more preferably 22 MPa or less.

From the viewpoint of producing a mineral base oil satisfying Requirements (III) and (IV), the reaction temperature in the hydrogenation process is preferably 200 to 400° C., more preferably 250 to 370° C., and further preferably 280 to 350° C.

From the viewpoint of producing a mineral base oil satisfying Requirements (III) and (IV), the liquid hourly space velocity (LHSV) in the hydrogenation process is preferably 5.0 $hr^{-1}$ or less, more preferably 2.0 $hr^{-1}$ or less, and further preferably 1.2 $hr^{-1}$ or less, and from the viewpoint of productivity, it is preferably 0.1 $hr^{-1}$ or more, more preferably 0.2 $hr^{-1}$ or more, and further preferably 0.3 $hr^{-1}$ or more.

The supply proportion of the hydrogen gas in the hydrogenation process is preferably 100 to 1000 $Nm^3$, more preferably 200 to 800 $Nm^3$, and further preferably 250 to 650 $Nm^3$ per kiloliter of the supplied oil to be processed.

The oil produced after the hydrogenation process may be subjected to vacuum distillation to remove a light fraction. The various conditions (pressure, temperature, time, etc.) of the vacuum distillation are appropriately adjusted so that the kinetic viscosity at 100° C. of the mineral base oil falls in a desired range.

[Lubricating Oil Composition]

The lubricating oil composition of the present invention contains at least the mineral base oil of the present invention as described above, and may contain a synthetic oil together with the mineral base oil to the extent that does not impair the effect of the present invention.

Examples of synthetic oils include poly-α-olefins (PAO), ester compounds, ether compounds, polyglycols, alkylbenzenes, and alkylnaphthalenes.

The synthetic oils may be used either alone or in combination of two or more thereof.

The content of the synthetic oil in the lubricating oil composition of the present invention is preferably 0 to 30 parts by mass, more preferably 0 to 20 parts by mass, further preferably 0 to 15 parts by mass, furthermore preferably 0 to 10 parts by mass, and particularly preferably 0 to 5 parts by mass based on 100 parts by mass of the whole amount of the mineral base oil of the present invention contained in the lubricating oil composition.

The content of the mineral base oil of the present invention in the lubricating oil composition of one embodiment of the present invention is generally 50% by mass or more, preferably 55% by mass or more, more preferably 60% by mass or more, further preferably 65% by mass or more, and furthermore preferably 70% by mass or more, and it is preferably 100% by mass or less, more preferably 99% by mass or less, and further preferably 95% by mass or less based on the whole amount (100% by mass) of the lubricating oil composition.

Since the lubricating oil composition of one embodiment of the present invention contains a mineral base oil satisfying the aforementioned Requirements (I) to (III), not only the oxidation stability of the mineral base oil itself, but also the antioxidant performance of the added antioxidant can be greatly improved owing to the use of the mineral base oil.

As a result, with an antioxidant incorporated, the lubricating oil composition can have greatly improved oxidation stability as compared to lubricating oil compositions including existing base oils.

As the antioxidant, any one is appropriately selected and used from among known antioxidants heretofore used as an antioxidant of lubricating oils, and examples include amine-based antioxidants, phenol-based antioxidants, molybdenum-based antioxidants, sulfur-based antioxidants, and phosphorus-based antioxidants.

Examples of amine-based antioxidants include diphenylamine-based antioxidants, such as diphenylamine, alkylated diphenylamines having an alkyl group of 3 to 20 carbon atoms; and naphthylamine-based antioxidants, such as α-naphthylamine, phenyl-α-naphthylamine, and substituted phenyl-α-naphthylamines having an alkyl group of 3 to 20 carbon atoms.

Examples of phenol-based antioxidants include monophenol-based antioxidants, such as 2,6-di-tert-butylphenol, 2,6-di-tert-butyl-p-cresol, 2,6-di-tert-butyl-4-ethylphenol, isooctyl-3-(3,5-di-tert-butyl-4-hydroxyphenyl)propionate, and octadecyl-3-(3,5-di-tert-butyl-4-hydroxyphenyl)propionate; and diphenol-based antioxidants, such as 4,4'-methylene bis(2,6-di-tert-butylphenol) and 2,2'-methylene bis(4-ethyl-6-tert-butylphenol); and hindered phenol-based antioxidant.

An example of molybdenum-based antioxidants is a molybdenum amine complex obtained by reacting molybdenum trioxide and/or molybdic acid with an amine compound.

An example of sulfur-based antioxidants is dilauryl-3,3'-thiodipropyonate.

Examples of phosphorus-based antioxidants include phosphite, diethyl 3,5-di-tert-butyl-4-hydroxybenzylphosphonate.

In one embodiment of the present invention, the antioxidants may be used either alone or in combination of two or more, and preferably used in combination of two or more.

The content of such an antioxidant in the lubricating oil composition of one embodiment of the present invention is preferably 0.01 to 10% by mass, more preferably 0.05 to 8% by mass, and further preferably 0.10 to 5% by mass based on the whole amount (100% by mass) of the lubricating oil composition.

The lubricating oil composition of the present invention may further contain commonly-used additives for lubricating oil other than antioxidants, as needed, to the extent that does not impair the effect of the present invention.

Examples of such additives for lubricating oil include a pour point depressant, a viscosity index improver, an anti-wear agent, an extreme pressure agent, an anti-foaming agent, a friction modifier, a rust inhibitor, a metal deactivator, and a demulsifier.

A compound having multiple functions as the aforementioned additives (for example a compound having functions as an anti-wear agent and an extreme pressure agent) may be used.

The additives for lubricating oil may be used either alone or in combination of two or more thereof.

The content of each of the additives for lubricating oil can be appropriately adjusted to the extent that does not impair the effect of the present invention, and is generally 0.001 to 15% by mass, preferably 0.005 to 10% by mass, and more preferably 0.01 to 8% by mass based on the whole amount (100% by mass) of the lubricating oil composition.

In the lubricating oil composition of one embodiment of the present invention, the total content of the additives for lubricating oil is preferably 0 to 30% by mass, more preferably 0 to 25% by mass, further preferably 0 to 20% by mass, and furthermore preferably 0 to 15% by mass based on the whole amount (100% by mass) of the lubricating oil composition.

(Pour Point Depressant)

Examples of pour point depressants include ethylene-vinyl acetate copolymers, condensates of chlorinated paraffins and naphthalene, condensates of chlorinated paraffins and phenol, polymethacrylates, and polyalkylstyrenes, and a polymethacrylate is preferably used.

(Viscosity Index Improver)

Examples of viscosity index improvers include polymers, such as nondispersive polymethacrylates, dispersive polymethacrylates, olefin-based copolymers (for example, ethylene-propylene copolymer), dispersive olefin-based copolymers, and styrene-based copolymers (for example, a styrene-diene copolymer, a styrene-isoprene copolymer).

The mass average molecular weight (Mw) of the viscosity index improvers is generally 500 to 1,000,000, preferably 5,000 to 800,000, and more preferably 10,000 to 600,000, and it is appropriately set according to the type of the polymer.

Nondispersive and dispersive polymethacrylates used as a viscosity index improver preferably have a mass average molecular weight of 5,000 to 1,000,000, more preferably 10,000 to 800,000, and further preferably 20,000 to 500,000.

Olefin-based copolymers used as a viscosity index improver preferably has that of 800 to 300,000, and more preferably 10,000 to 200,000.

As used herein, the mass average molecular weight (Mw) of each component refers to a value in terms of standard polystyrene measured by a gel permeation chromatography (GPC) method.

(Anti-Wear Agent, Extreme Pressure Agent)

Examples of anti-wear agents or extreme pressure agents include sulfur-containing compounds, such as zinc dialkyldithiophosphates (ZnDTP), zinc phosphate, zinc dithiocarbamate, molybdenum dithiocarbamate, molybdenum dithiophosphate, disulfides, sulfurized olefins, sulfurized oils and fats, sulfurized esters, thiocarbonates, thiocarbamates, and polysulfides; phosphorus-containing compounds, such as phosphite esters, phosphate esters, phosphonate esters, and amine salts or metal salts thereof; and sulfur-and-phosphorus-containing compounds, such as thiophosphite esters, thiophosphate esters, thiophosphonate esters, and amine salts or metal salts thereof.

(Anti-Foaming Agent)

Examples of anti-foaming agents include silicone oils, fluorosilicone oils, and fluoroalkyl ethers.

(Friction Modifier)

Examples of friction modifiers include molybdenum-based friction modifiers, such as molybdenum dithiocarbamate (MoDTC), molybdenum dithiophosphate (MoDTP), and amine salts of molybdic acid; ash-free friction modifiers, such as aliphatic amines, fatty acid esters, fatty acid amides, fatty acids, aliphatic alcohols, and aliphatic ethers, each having at least one alkyl group or alkenyl group having 6 to 30 carbon atoms in the molecule; oils and fats; amines; amides; sulfurized esters; phosphate esters; phosphite esters; and phosphate ester amine salts.

(Rust Inhibitor)

Examples of rust inhibitors include fatty acids, alkenylsuccinic acid half esters, fatty acid soaps, alkylsulfonic acid salts, polyhydric alcohol fatty acid esters, fatty acid amines, oxidized paraffins, and alkyl polyoxyethylene ethers.

(Metal Deactivator)

Examples of the metal deactivators include benzotriazole compounds, tolyltriazole compounds, thiadiazole compounds, imidazole compounds, and pyrimidine compounds.

In one embodiment of the present invention, these metal deactivators may be used either alone or in combination of two or more thereof.

(Demulsifier)

Examples of demulsifiers include anionic surfactants, such as caster oil sulfate ester salts and petroleum sulfonate salts; cationic surfactants, such as quarternary ammonium salts and imidazolines; polyoxyalkylene polyglycols and dicarboxylate esters thereof; and alkylphenol-formaldehyde polycondensate alkylene oxide adducts.

<Method for Producing Lubricating Oil Composition>

A method for producing the lubricating oil composition of the present invention is not particularly limited. As a method for producing a lubricating oil composition containing the aforementioned additives for lubricating oil, preferred is a method having a step of blending such additives for lubricating oil into a base oil containing the mineral base oil of the present invention.

In the above step, a suitable compound used as each additive for lubricating oil to be blended and the content of the component are as described above.

It is preferred that additives for lubricating oil are blended into a base oil containing the mineral base oil of the present invention, and then the mixture is stirred by a known method to uniformly disperse the additives for lubricating oil in the base oil.

From the viewpoint of uniform dispersion of the additives for lubricating oil, it is preferred that the base oil containing the mineral base oil of the present invention is heated to 40 to 70° C., and then the additives for lubricating oil are blended and the mixture is stirred for uniform dispersion.

<Physical Properties of Lubricating Oil Composition>

The kinetic viscosity at 100° C. of the lubricating oil composition of one embodiment of the present invention is preferably 7 $mm^2/s$ or more, more preferably 7.1 $mm^2/s$ or more, and further preferably 7.2 $mm^2/s$ or more, and it is preferably less than 10 $mm^2/s$, more preferably less than 9.9 $mm^2/s$, further preferably less than 9.8 $mm^2/s$, and furthermore preferably less than 9.6 $mm^2/s$.

The viscosity index of the lubricating oil composition of one embodiment of the present invention is preferably 100 or more, more preferably 110 or more, and further preferably 120 or more, and it is generally 160 or less.

<Use of Lubricating Oil Composition, Lubricating Method>

The lubricating oil composition of one embodiment of the present invention can be suitably used as: a turbine oil used for lubrication of turbomachines, such as a pump, a vacuum pump, a blower, a turbocompressor, a steam turbine, a nuclear turbine, a gas turbine, and a turbine for hydraulic power generation; a bearing oil, a gear oil, and control system operating fluid, used for lubrication of compressors, such as a rotational compressor and a reciprocating compressor; a hydraulic operating fluid used for hydraulic instruments; a lubricating oil for machine tool used for machine tools, such as a high speed punching press, a high speed rolling mill, and a high speed pile driver.

Specifically, the present invention also provides an instrument of the following (1), and a lubricating method of the following (2).

(1) An instrument, which is selected from a turbomachine, a compressor, a hydraulic instrument, and a machine tool, using the lubricating oil composition of the present invention.

(2) A lubricating method, including using the lubricating oil composition of the present invention for an instrument selected from a turbomachine, a compressor, a hydraulic instrument, and a machine tool.

[Grease Composition]

The grease composition of the present invention contains at least the mineral base oil of the present invention and a thickener.

Because of containing the mineral base oil of the present invention having high oxidation stability, the grease composition of the present invention can have improved oxidation stability as compared to existing greases.

From the viewpoint of providing a grease composition having further improved oxidation stability, the grease composition of one embodiment of the present invention preferably further contains an antioxidant.

The grease composition of one embodiment of the present invention may contain a synthetic oil together with other additives than antioxidants and the mineral base oil of the present invention, to the extent that does not impair the effect of the present invention.

Examples of the synthetic oils that can be contained in the grease composition of one embodiment of the present invention include the same synthetic oils as can be contained in the lubricating oil composition of the present invention.

The content of the synthetic oil in the grease composition of the present invention is preferably 0 to 30 parts by mass, more preferably 0 to 20 parts by mass, further preferably 0 to 15 parts by mass, furthermore preferably 0 to 10 parts by mass, and particularly preferably 0 to 5 parts by mass, based on 100 parts by mass of the whole amount of the mineral base oil of the present invention contained in the grease composition.

The content of the mineral base oil of the present invention in the grease composition of one embodiment of the present invention is generally 20% by mass or more, preferably 40% by mass or more, more preferably 50% by mass or more, further preferably 60% by mass or more, and furthermore preferably 70% by mass or more, and it is preferably 99% by mass or less, more preferably 97% by mass or less, further preferably 95% by mass or less, and furthermore preferably 93% by mass or less based on the whole amount (100% by mass) of the grease composition.

<Thickener>

The thickener contained in the grease composition of one embodiment of the present invention is preferably one or more selected from metal soaps and urea compounds.

The content of the thickener in the grease composition of one embodiment of the present invention is preferably 1 to 40% by mass, more preferably 1 to 35% by mass, further preferably 3 to 30% by mass, and furthermore preferably 5 to 25% by mass based on the whole amount (100% by mass) of the grease composition.

(Metal Soap)

The metal soap used as the thickener may be a metal soap composed of a monovalent fatty acid metal salt, or a metal complex soap composed of a monovalent fatty acid metal salt and a divalent fatty acid metal salt.

The metal atom constituting the metal soap and metal complex soap is preferably a metal atom selected from alkaline metal atoms and alkaline earth metal atoms, more preferably an alkaline metal atom, and further preferably a lithium atom.

That is, the metal soap used in one embodiment of the present invention is preferably one or more selected from lithium soaps and lithium complex soaps.

Examples of monovalent fatty acids constituting the monovalent fatty acid metal salt of the metal soap and metal complex soap include saturated fatty acids, such as lauric acid, tridecyl acid, myristic acid, pentadecyl acid, palmitic acid, margaric acid, stearic acid, nonadecyl acid, arachidic acid, behenic acid, lignoceric acid, and tallow fatty acid; hydroxy group-containing fatty acids, such as 9-hydroxystearic acid, 10-hydroxystearic acid, 12-hydroxystearic acid, 9,10-hydroxystearic acid, ricinoleic acid, and ricinoelaidic acid; and unsaturated fatty acids, such as dodecenyl acid, hexadecenyl acid, octadecenyl acid (including oleic acid), icosenyl acid, henicosenyl acid, tricosenyl acid, and tetracosenyl acid.

Among them, as a monovalent fatty acid, saturated fatty acids having 12 to 24 (preferably 12 to 18, more preferably 14 to 18) carbon atoms are preferred, stearic acid, 9-hydroxystearic acid, 10-hydroxystearic acid, 12-hydroxystearic acid, and octadecenyl acid are more preferred, and stearic acid, 12-hydroxystearic acid, and oleic acid are further preferred.

The monovalent fatty acids may be used either alone or in combination of two or more thereof.

Examples of divalent fatty acids constituting the divalent fatty acid metal salt of the metal complex soap include succinic acid, malonic acid, glutaric acid, adipic acid, pimelic acid, suberic acid, azelaic acid, and sebacic acid.

Among them, the divalent fatty acid is preferably azelaic acid or sebacic acid, and more preferably azelaic acid.

The metal soap is generally obtained by reacting a fatty acid with a metal hydroxide.

Specifically, a raw material fatty acid is blended with the mineral base oil of the present invention and dissolved with heat to prepare a solution of the fatty acid, and then a metal hydroxide is added and reacted, whereby the metal soap can be synthesized.

The metal hydroxide is preferably added as an aqueous solution in which it is dissolved in water.

When the metal hydroxide is added as an aqueous solution, it is preferred that the solution is heated to 100° C. or more to remove water and the residue is then further heated to promote the reaction.

(Urea Compound)

The urea compound used as the thickener may be any compound having a urea bond, and preferably is a diurea compound having two urea bonds, and more preferably a compound represented by the following general formula (b1).

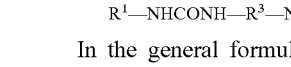

$$R^1—NHCONH—R^3—NHCONH—R^2 \quad (b1)$$

In the general formula (b1), $R^1$ and $R^2$ independently represent a monovalent hydrocarbon group having 6 to 24 carbon atoms, and $R^1$ and $R^2$ may be the same as or different from each other. $R^3$ represents a divalent aromatic hydrocarbon group having 6 to 18 carbon atoms.

The carbon number of the monovalent hydrocarbon group that can be selected as $R^1$ and $R^2$ in the general formula (b1) is 6 to 30, but it is preferably 6 to 24, and more preferably 6 to 20.

Examples of the monovalent hydrocarbon groups that can be selected as $R^1$ and $R^2$ include saturated or unsaturated monovalent chain hydrocarbon groups, saturated or unsaturated monovalent alicyclic hydrocarbon groups, and monovalent aromatic hydrocarbon groups, and preferably saturated or unsaturated monovalent chain hydrocarbon groups and saturated or unsaturated monovalent alicyclic hydrocarbon groups.

Examples of monovalent saturated chain hydrocarbon groups include straight-chain or branched-chain alkyl groups having 6 to 24 carbon atoms, and specific examples include a hexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, an octadecyl group, an octadecenyl group, a nonadecyl group, and an icosyl group.

Examples of monovalent unsaturated chain hydrocarbon groups include straight-chain or branched-chain alkenyl group having 6 to 24 carbon atoms, and specific examples include a hexenyl group, a heptenyl group, an octenyl group, a nonenyl group, a decenyl group, a dodecenyl group, a tridecenyl group, a tetradecenyl group, a pentadecenyl group, a hexadecenyl group, an octadecenyl group, a nonadecenyl group, an icosenyl group, an oleyl group, a geranyl group, a farnesyl group, and a linoleyl group.

The monovalent saturated chain hydrocarbon group and monovalent unsaturated chain hydrocarbon group may be a straight chain group or a branched chain group.

The carbon number of the monovalent saturated chain hydrocarbon group and monovalent unsaturated chain hydrocarbon group is preferably 6 to 20, more preferably 12 to 20, and further preferably 14 to 20.

Examples of monovalent saturated alicyclic hydrocarbon groups include cycloalkyl groups, such as cyclohexyl group, cycloheptyl group, cyclooctyl group, and cyclononyl group; and cycloalkyl groups substituted with an alkyl group having 1 to 6 carbon atoms (preferably cyclohexyl groups substituted with an alkyl group having 1 to 6 carbon atoms), such as a methylcyclohexyl group, a dimethylcyclohexyl group, an ethylcyclohexyl group, a diethylcyclohexyl group, a propylcyclohexyl group, an isopropylcyclohexyl group, a 1-methyl-propylcyclohexyl group, a butylcyclohexyl group, a pentylcyclohexyl group, a pentyl-methylcyclohexyl group, and a hexylcyclohexyl group.

Examples of monovalent unsaturated alicyclic hydrocarbon groups include cycloalkenyl group, such as a cyclohexenyl group, a cycloheptenyl group, and cyclooctenyl group; and cycloalkenyl groups substituted with an alkyl group having 1 to 6 carbon atoms (preferably cyclohexenyl groups substituted with an alkyl group having 1 to 6 carbon atoms), such as a methylcyclohexenyl group, a dimethylcyclohexenyl group, an ethylcyclohexenyl group, a diethylcyclohexenyl group, and a propylcyclohexenyl group.

The carbon number of monovalent saturated alicyclic hydrocarbon group and monovalent unsaturated alicyclic hydrocarbon group is preferably 6 to 20, more preferably 6 to 18, further preferably 6 to 15, and furthermore preferably 6 to 13.

Examples of monovalent aromatic hydrocarbon groups include a phenyl group, a biphenyl group, a terphenyl group, a naphthyl group, a diphenylmethyl group, a diphenylethyl group, a diphenylpropyl group, a methylphenyl group, a dimethylphenyl group, an ethylphenyl group, and a propylphenyl group.

The carbon number of the monovalent aromatic hydrocarbon group is preferably 6 to 20, more preferably 6 to 18, further preferably 6 to 15, and furthermore preferably 6 to 13.

The carbon number of the divalent aromatic hydrocarbon group that can be selected as $R^3$ in the general formula (b1) is 6 to 18, but it is preferably 6 to 15, and more preferably 6 to 13.

Examples of the divalent aromatic hydrocarbon group that can be selected as $R^3$ include a phenylene group, a diphenylmethylene group, a diphenylethylene group, a diphenylpropylene group, a methylphenylene group, a dimethylphenylene group, and an ethylphenylene group.

Among them, a phenylene group, a diphenylmethylene group, a diphenylethylene group, or diphenylpropylene group is preferred, and a diphenylmethylene group is more preferred.

A diurea compound is generally obtained by reacting a diisocyanate with a monoamine.

Specifically, a diisocyanate is blended with a part of the mineral base oil of the present invention and is dissolved with heat to prepare a solution of the diisocyanate, and then a solution of a monoamine dissolved in the remaining mineral base oil is added thereto, and the mixture is reacted, whereby a diurea compound can be produced.

For example, in the case of synthesizing a compound represented by the general formula (b1), such a desired diurea compound can be synthesized according to the method described above by using a diisocyanate having a group corresponding to the divalent aromatic hydrocarbon group represented by $R^3$ in the general formula (b1) as the diisocyanate and using an amine having groups corresponding to the monovalent hydrocarbon groups represented by $R^1$ and $R^2$ as the monoamine.

<Antioxidant>

The grease composition of one embodiment of the present invention preferably further contains an antioxidant.

Specifically, since the grease composition of one embodiment of the present invention contains a mineral base oil satisfying the aforementioned Requirements (I) to (III), not only the oxidation stability of the mineral base oil itself, but also the antioxidant performance of the added antioxidant can be greatly improved by the use of the mineral base oil.

As a result, with an antioxidant incorporated, the grease composition can has greatly improved oxidation stability as compared with grease compositions including existing base oils.

As the antioxidant, any of known antioxidants which have heretofore been used as an antioxidant for lubricating oil can be appropriately selected and used. Examples include amine-based antioxidants, phenol-based antioxidants, molybdenum-based antioxidants, sulfur-based antioxidants, and phosphorus-based antioxidants, and specific examples include the same antioxidants as can be contained in the lubricating oil composition as described above.

The antioxidants may be used either alone or in combination of two or more thereof.

The content of the antioxidant in the grease composition of one embodiment of the present invention is preferably 0.01 to 10% by mass, more preferably 0.05 to 8% by mass, and further preferably 0.10 to 5% by mass based on the whole amount (100% by mass) of the grease composition.

<Additives>

Besides the aforementioned antioxidants, the grease composition of one embodiment of the present invention may contain any additives which are to be blended to a common grease to the extent that does not impair the effect of the present invention.

Example of such additives include a rust inhibitor, an extreme pressure agent, a viscosity enhancer, a solid lubricating agent, a detergent dispersant, a corrosion inhibitor, and a metal deactivator.

The additives may be used either alone or in combination of two or more thereof.

Examples of rust inhibitors include sorbitan fatty acid esters and amine compounds.

Examples of extreme pressure agents include phosphorus-based compounds.

Examples of viscosity enhancers include polymethacrylates (PMA), olefin copolymers (OCP), polyalkylstyrenes (PAS), and styrene-diene copolymers (SCP).

Examples of solid lubricating agents include polyimides and melamine cyanurate (MCA).

Examples of detergent dispersants include ashless dispersants, such as succinimide and boron-based succinimides.

Examples of corrosion inhibitors include benzotriazole compounds and thiazole compounds.

Examples of metal deactivators include benzotriazole compounds.

The content of each additive in the grease composition of one embodiment of the present invention is appropriately adjusted depending on the type and use purpose of the additive, but generally 0 to 10% by mass, preferably 0.001 to 7% by mass, and more preferably 0.01 to 5% by mass based on the whole amount (100% by mass) of the grease composition.

<Method for Producing Grease Composition>

A non-limiting example of methods of producing the grease composition of the present invention is a method including the following steps (1) to (2).

Step (1): a raw material of a thickener is added to the mineral base oil of the present invention to synthesize the thickener.

Step (2): after Step (1), additives such as an antioxidant are blended as needed.

Step (1) is as described above although the specific operations are different between the case of using a metal soap and the case of using a urea compound as the thickener.

In Step (2), in the case of blending additives such as an antioxidant as needed after Step (1), the additives may be blended in the course of cooling to room temperature after completion of the reaction of Step (1) or may be blended after cooling to room temperature.

A milling treatment is preferably applied after Step (2) using a colloid mill or a roll mil.

<Physical Properties of Grease Composition>

From the viewpoint of producing a grease having proper hardness, and excellent workability and lubricating performance, the grease composition of one embodiment of the present invention preferably has a worked penetration at 25° C. of 175 to 475.

As used herein, the worked penetration of a grease means a value measured according to JIS K2220.7.

An evaporation rate of the grease composition after 24 hours at 150° C. of the grease composition of one embodiment of the present invention is preferably 25% or less, more preferably 20% or less, further preferably 10% or less, furthermore preferably 5% or less, and particularly preferably 1% or less as measured by a thin film oxidation test as described later in Examples.

<Use of Grease Composition>

The grease composition of the present invention can also be suitably used, for example, for various bearings, such as a slide bearing, a rolling bearing, an oil retaining bearing, and a fluid bearing, speed reducers, gears, internal combustion engines, brakes, components for torque transmission apparatuses, fluid couplings, components for compressors, chains, components for hydraulic apparatuses, components for vacuum pump apparatuses, clock components, components for hard discs, components for refrigerators, components for cutting machines, components for rolling mills, components for drawing benches, components for rolling machines, components for automobiles, components for forging machines, components for heat treatment machines, components for heat media, components for cleaners, components for shock absorbers, components for sealing apparatuses, and the like.

In particular, the grease composition of the present invention is suitably used for applications in which high oxidation stability is desired since it has excellent oxidation stability.

EXAMPLES

Examples of the present invention will be described in detail below, but the present invention is by no means limited to the examples. Methods for measuring and evaluation of physical properties are as follows.

<Methods for Measurement of Physical Properties of Mineral Base Oil or Lubricating Oil Composition>

(1) Kinetic Viscosity at 40° C. and 100° C.

It was measured according to JIS K2283:2000.

(2) Viscosity Index

It was measured according to JIS K2283:2000.

<Methods of Measurement of Physical Properties of Mineral Base Oil>

(3) Complex Viscosity η* at −5° C. and −15° C.

It was measured using a rotary rheometer "Physica MCR 301" manufactured by Anton Paar according to the following procedure.

First, a mineral base oil or a lubricating oil composition to be measured was inserted in a corn plate (diameter: 50 mm, angle of inclination: 1°) adjusted to a measurement temperature of −5° C. or −15° C., and then kept at the same temperature for 10 minutes. During the time, care was taken not to give a strain to the inserted solution.

Then, the complex viscosity η* at each measurement temperature was measured using the above rotary rheometer in a vibration mode at an angular velocity of 6.3 rad/s. In the measurements of the complex viscosity η* with the rotary rheometer, the "strain amount" was "3.4 to 3.5%" in measurements at −5° C. and "1.1%" in measurements at −15° C.

Then, "temperature gradient Δ|η*| of complex viscosity" was calculated from the values of complex viscosity η* at −5° C. and −15° C. using the aforementioned calculation formula (f1).

(4) Aromatic Content (% $C_A$), Naphthene Content (% $C_N$)

They were measured according to ASTM D-3238 ring analysis (n-d-M method).

(5) Sulfur Content

It was measured according to JIS K2541-6:2003.

(6) Nitrogen Content

It was measured according to JIS K2609:1998 4.

<Method of Measurement of Physical Properties of Lubricating Oil Composition>

(7) RPVOT Value

According to the rotating pressure vessel oxidation test (RPVOT) of JIS K 2514-3, a time for reduction of the pressure by 175 kPa from the highest pressure (RPVOT value) was measured at a test temperature of 150° C. and with a pressure before heating of 620 kPa. A longer time (larger RPVOT value) means a lubricating oil composition having better oxidation stability.

<Method of Measurement of Physical Properties of Grease Composition>

(8) Worked Penetration

It was measured according to ASTM D 217 method at 25° C.

(9) Thin Film Oxidation Test

A hollow rubber plate with a thickness of 2 mm in which a rectangular shape of 45 mm width×65 mm length was cut out was superimposed on a surface of a steel plate (thickness 8 mm, width 60 mm, length 80 mm) defined in JIS G 3141 (SPCC, SD), and a grease composition to be measured was applied with a spatula on the surface of the steel plate exposed from the hollow portion of the rubber plate. Then, the rubber plate was removed to form a thin film of the grease composition having a thickness of 2 mm on the steel plate, whereby a test sample was produced.

The mass of the produced test sample was measured and the mass of the grease composition before the test was calculated from the difference between the mass of the test sample and the mass of the steel plate.

Then, the test sample was placed in a thermostat at 150° C. and was subjected to a heat treatment at 150° C. for 24 hours for a thin film oxidation test. The mass of the test sample was measured after the test, and the mass of the grease composition after the test was calculated in the same manner as above to determine the evaporation rate of the grease composition using the following formula. A lower evaporation rate means a less likelihood of evaporation and a higher oxidation stability of the grease composition.

Evaporation rate (%)=[(Mass of grease composition before test)−(Mass of grease composition after test)]/(Mass of grease composition before test)×100

Methods for producing a "bottom oil" and a "slack wax" used in Examples and Comparative Examples are as follows.

Production Example 1 (Production of Bottom Oil)

A bottom fraction, which is obtained, in a common fuel oil production process, in a step of hydrocracking an oil containing a heavy fuel oil obtained from a vacuum distillation apparatus to produce naphtha and kerosene-gas oil, was taken out to thereby obtain a "bottom oil".

The bottom oil had an oil content of 75% by mass, a sulfur content of 82 ppm by mass, a nitrogen content of 2 ppm by mass, a kinetic viscosity at 100° C. of 4.1 $mm^2/s$, and a viscosity index of 134.

Production Example 2 (Production of Solvent-Dewaxed Oil and Slack Wax)

A bottom oil obtained as above was subjected to solvent dewaxing with a mixed solvent of methyl ethyl ketone and toluene in a low temperature region of −35° C. to −30° C. to separate wax to obtain a "solvent-dewaxed oil". The separated wax was taken as a "slack wax".

The solvent-dewaxed oil had an oil content of 100% by mass, a sulfur content of 70 ppm by mass, a nitrogen content of 2 ppm by mass, a kinetic viscosity at 100° C. of 4.1 $mm^2/s$, and a viscosity index of 121.

The slack wax had an oil content of 15% by mass, a sulfur content of 12 ppm by mass, a nitrogen content of less than 1 ppm by mass, a kinetic viscosity at 100° C. of 4.2 $mm^2/s$, and a viscosity index of 169.

Example 1 (Production of Mineral Base Oil (A))

A mixture of 95 parts by mass of the slack wax obtained in Production Example 2 and 5 parts by mass of the bottom oil obtained in Production Example 1 were used as a feedstock oil (a). The feedstock oil (a) had an oil content of 15% by mass, a sulfur content of 19 ppm by mass, a nitrogen content of less than 1 ppm by mass, a kinetic viscosity at 100° C. of 4.2 $mm^2/s$, and a viscosity index of 175.

The feedstock oil (a) was subjected to hydrogenation isomerization dewaxing using a hydrogenation isomerization dewaxing catalyst under conditions at a hydrogen partial pressure of 4 MPa, a reaction temperature of 340° C., and a LHSV of 0.5 $hr^{-1}$.

Next, the oil produced through the hydrogenation isomerization dewaxing was subjected to a hydrogenation process using a nickel-tungsten catalyst under conditions at a hydrogen partial pressure of 20 MPa, a reaction temperature of 280 to 320° C., and a LHSV of 1.0 $hr^{-1}$.

The oil produced through the hydrogenation process was subjected to vacuum distillation and a fraction having a kinetic viscosity at 100° C. in the range of 7.2 to 7.7 $mm^2/s$ was collected to thereby obtain a mineral base oil (A).

The mineral base oil (A) had an aromatic content (% $C_A$) of 0.0, a naphthene content (% $C_N$) of 16.7, a sulfur content of less than 10 ppm by mass, and a nitrogen content of less than 1 ppm by mass.

Example 2 (Production of Mineral Base Oil (B))

A mixture of 90 parts by mass of the slack wax obtained in Production Example 2 and 10 parts by mass of the bottom oil obtained in Production Example 1 was used as a feedstock oil (b). The feedstock oil (b) had an oil content of 21% by mass, a sulfur content of 22 ppm by mass, a nitrogen content of less than 1 ppm by mass, a kinetic viscosity at 100° C. of 4.0 $mm^2/s$, and a viscosity index of 162.

The feedstock oil (b) was subjected to a hydrogenation process using a nickel-tungsten catalyst under conditions at a hydrogen partial pressure of 4 MPa, a reaction temperature of 340° C., and a LHSV of 1.0 $hr^{-1}$.

The oil produced through the hydrogenation process was subjected to vacuum distillation and a fraction having a kinetic viscosity at 100° C. in the range of 7.2 to 7.7 $mm^2/s$ was collected to thereby obtain a mineral base oil (B).

The mineral base oil (B) had an aromatic content (% $C_A$) of 0.0, a naphthene content (% $C_N$) of 26.5, a sulfur content of less than 10 ppm by mass, and a nitrogen content of less than 1 ppm by mass.

Comparative Example 1 (Production of Mineral Base Oil (C))

A heavy fuel oil obtained from a vacuum distillation apparatus in a common fuel oil production process was subjected to solvent extraction with a furfural solvent in a condition at a solvent ratio of 1.0 to 2.0 to thereby obtain raffinate.

The raffinate was then subjected to hydrogenation isomerization dewaxing using a hydrogenation isomerization dewaxing catalyst under conditions at a hydrogen partial pressure of 4 MPa, a reaction temperature of 260 to 280° C., and a LHSV of 1.0 $hr^{-1}$.

Next, the oil produced through the hydrogenation isomerization dewaxing was subjected to a hydrogenation process using a nickel-tungsten catalyst under conditions at a hydrogen partial pressure of 4 to 5 MPa, a reaction temperature of 280 to 320° C., and a LHSV of 1.0 $hr^{-1}$ The oil produced through the hydrogenation process was subjected to vacuum distillation and a fraction having a kinetic viscosity at 100° C. in the range of 6.2 to 6.7 $mm^2/s$ was collected to thereby obtain a mineral base oil (C).

The mineral base oil (C) had an aromatic content (% $C_A$) of 2.8, a naphthene content (% $C_N$) of 27.3, and a sulfur content of 1000 ppm by mass.

The properties of the mineral base oils (A) to (C) produced in Examples and Comparative Example are shown in Table 1.

TABLE 1

| | | Example | | Comparative Example |
|---|---|---|---|---|
| Properties | Unit | 1 Mineral base oil (A) | 2 Mineral base oil (B) | 1 Mineral base oil (C) |
| Kinetic viscosity at 40° C. | $mm^2/s$ | 40.25 | 45.72 | 42.24 |
| Kinetic viscosity at 100° C. | $mm^2/s$ | 7.356 | 7.587 | 6.473 |
| Viscosity index | — | 150 | 133 | 103 |
| Temperature gradient $\Delta\lvert\eta^*\rvert$ of complex viscosity between two points of −5° C. and −15° C. | mPa · s/° C. | 55 | 186 | 354 |
| Complex viscosity $\eta^*$ at −15° C. | mPa · s | 959.0 | 2230.0 | 3830.0 |

Examples 3 to 8, Comparative Examples 2 to 4

As shown in Tables 2 to 4, additives in types and amounts shown in Tables 2 to 4 are blended into any one of the mineral base oils (A) to (C) produced in Examples and Comparative Example to thereby prepare each of lubricating oil compositions (P1) to (P6) and (Q1) to (Q3).

Details of the additives shown in Tables 2 to 4 used for preparing the lubricating oil compositions are as follows.

Phenol-based antioxidant: 2,6-di-tert-butyl-p-cresol

Amine-based antioxidant (1): bis(octylphenyl)amine

Amine-based antioxidant (2): butylphenyloctylphenylamine

Amine-based antioxidant (3): octylphenylnaphthylamine

Phosphorus-based antioxidant: diethyl 3,5-di-tert-butyl-4-hydroxybenzylphosphonate Friction modifier: fused amide of isostearic acid and tetraethylenepentamine Anti-wear agent: a phosphate ester amine salt Extreme pressure agent: tricresyl phosphate Viscosity index improver: a polymethacrylate Rust inhibitor: an alkenylsuccinic acid half ester Metal deactivator (1): a thiadiazole Metal deactivator (2): benzotriazole Anti-foaming agent: a silicone-based anti-foaming agent The prepared lubricating oil compositions (P1) to (P6) and (Q1) to (Q3) were measured for the kinetic viscosity at 40° C. and 100° C., the viscosity index, and the RPVOT value according to the aforementioned measurement methods. The results are shown in Table 2 to 4.

TABLE 2

| | | | | Example | | Comparative Example |
|---|---|---|---|---|---|---|
| | | | | 3 | 4 | 2 |
| | Lubricating oil composition | | | (P1) | (P2) | (Q1) |
| Composition | Mineral base oil | Mineral base oil (A) from Example 1 | mass % | 98.85 | | |
| | | Mineral base oil (B) from Example 2 | | | 98.85 | |
| | | Mineral base oil (C) from Comparative Example 1 | | | | 98.85 |
| | Lubricating oil additive | Phenol-based antioxidant | mass % | 0.60 | 0.60 | 0.60 |
| | | Amine-based antioxidant (1) | | | | |
| | | Amine-based antioxidant (2) | | | | |
| | | Amine-based antioxidant (3) | | | | |
| | | Phosphorus-based antioxidant | | | | |
| | | Friction modifier | | | | |
| | | Anti-wear agent | | | | |
| | | Extreme pressure agent | | 0.40 | 0.40 | 0.40 |
| | | Viscosity index improver | | | | |
| | | Rust inhibitor | | 0.05 | 0.05 | 0.05 |
| | | Metal deactivator (1) | | | | |
| | | Metal deactivator (2) | | | | |
| | | Anti-foaming agent | | 0.10 | 0.10 | 0.10 |
| | | Total | mass % | 100.00 | 100.00 | 100.00 |
| Properties of lubricating oil composition | | Kinetic viscosity at 40° C. | $mm^2/s$ | 39.48 | 45.35 | 41.36 |
| | | Kinetic viscosity at 100° C. | $mm^2/s$ | 7.229 | 7.428 | 6.363 |
| | | Viscosity index | — | 148 | 128 | 102 |
| Evaluation | | RPVOT value (150° C., 620 kPa) | min | 361 | 371 | 274 |

The lubricating oil compositions (P1) to (P2) prepared in Examples 3 to 4 and the lubricating oil composition (Q1) prepared in Comparative Example 2 were those prepared by appropriately selecting and blending additives into a mineral base oil for applications in steam turbines and general-purpose hydraulic instruments.

As can be seen from Table 2, the lubricating oil compositions (P1) to (P2) prepared in Example 3 to 4 have higher RPVOT values and thus has higher oxidation stability as compared with the lubricating oil composition (Q1) prepared in Comparative Example 2.

TABLE 3

| | | | | Example | | Comparative Example |
|---|---|---|---|---|---|---|
| | | | | 5 | 6 | 3 |
| | Lubricating oil composition | | | (P3) | (P4) | (Q2) |
| Composition | Mineral base oil | Mineral base oil (A) from Example 1 | mass % | 97.65 | | |
| | | Mineral base oil (B) from Example 2 | | | 97.65 | |
| | | Mineral base oil (C) from Comparative Example 1 | | | | 97.65 |
| | Lubricating oil additive | Phenol-based antioxidant | mass % | 0.60 | 0.60 | 0.60 |
| | | Amine-based antioxidant (1) | | | | |
| | | Amine-based antioxidant (2) | | 0.20 | 0.20 | 0.20 |
| | | Amine-based antioxidant (3) | | | | |
| | | Phosphorus-based antioxidant | | | | |
| | | Friction modifier | | 0.01 | 0.01 | 0.01 |
| | | Anti-wear agent | | 0.02 | 0.02 | 0.02 |
| | | Extreme pressure agent | | 0.80 | 0.80 | 0.80 |
| | | Viscosity index improver | | 0.50 | 0.50 | 0.50 |
| | | Rust inhibitor | | 0.05 | 0.05 | 0.05 |
| | | Metal deactivator (1) | | 0.06 | 0.06 | 0.06 |
| | | Metal deactivator (2) | | 0.01 | 0.01 | 0.01 |
| | | Anti-foaming agent | | 0.10 | 0.10 | 0.10 |
| | | Total | mass % | 100.00 | 100.00 | 100.00 |
| Properties of lubricating oil composition | | Kinetic viscosity at 40° C. | $mm^2/s$ | 40.20 | 46.23 | 42.36 |
| | | Kinetic viscosity at 100° C. | $mm^2/s$ | 7.358 | 7.603 | 6.559 |
| | | Viscosity index | — | 143 | 131 | 106 |
| Evaluation | | RPVOT value (150° C., 620 kPa) | min | 838 | 651 | 415 |

The lubricating oil compositions (P3) to (P4) prepared in Examples 5 to 6 and the lubricating oil composition (Q2) prepared in Comparative Example 3 were those prepared by appropriately selecting and blending additives into a mineral base oil for applications in hydraulic instruments to be exposed to high pressure loads.

As can be seen from Table 3, the lubricating oil compositions (P3) to (P4) prepared in Examples 5 to 6 has higher RPVOT values and thus has higher oxidation stability as compared with the lubricating oil composition (Q2) prepared in Comparative Example 3.

TABLE 4

| | | | | Example | | Comparative Example |
|---|---|---|---|---|---|---|
| | | | | 7 | 8 | 4 |
| Lubricating oil composition | | | | (P5) | (P6) | (Q3) |
| Composition | Mineral base oil | Mineral base oil (A) from Example 1 | mass % | 99.11 | | |
| | | Mineral base oil (B) from Example 2 | | | 99.11 | |
| | | Mineral base oil (C) from Comparative Example 1 | | | | 99.11 |
| | Lubricating oil additive | Phenol-based antioxidant | mass % | | | |
| | | Amine-based antioxidant (1) | | 0.10 | 0.10 | 0.10 |
| | | Amine-based antioxidant (2) | | | | |
| | | Amine-based antioxidant (3) | | 0.25 | 0.25 | 0.25 |
| | | Phosphorus-based antioxidant | | 0.02 | 0.02 | 0.02 |
| | | Friction modifier | | | | |
| | | Anti-wear agent | | | | |
| | | Extreme pressure agent | | 0.40 | 0.40 | 0.40 |
| | | Viscosity index improver | | | | |
| | | Rust inhibitor | | 0.05 | 0.05 | 0.05 |
| | | Metal deactivator (1) | | | | |
| | | Metal deactivator (2) | | 0.02 | 0.02 | 0.02 |
| | | Anti-foaming agent | | 0.05 | 0.05 | 0.05 |
| | | Total | mass % | 100.00 | 100.00 | 100.00 |
| Properties of lubricating oil composition | | Kinetic viscosity at 40° C. | $mm^2/s$ | 40.18 | 45.92 | 41.97 |
| | | Kinetic viscosity at 100° C. | $mm^2/s$ | 7.352 | 7.505 | 6.448 |
| | | Viscosity index | — | 141 | 129 | 103 |
| Evaluation | | RPVOT value (150° C., 620 kPa) | min | 1779 | 1729 | 1221 |

The lubricating oil compositions (P5) to (P6) prepared in Examples 7 to 8 and the lubricating oil composition (Q3) prepared in Comparative Example 4 were those prepared by appropriately selecting and blending additives into a mineral base oil for applications in gas turbines and compressors.

As can be seen from Table 4, the lubricating oil compositions (P5) to (P6) prepared in Examples 7 to 8 has higher RPVOT values and thus has higher oxidation stability as compared with the lubricating oil composition (Q3) prepared in Comparative Example 4.

Examples 9 to 12, Comparative Examples 5 to 6

Into a 1 L metal vessel, a mineral base oil in a type shown in Table 5, and 12-hydroxystearic acid and oleic acid in an amount shown in Table 5 were added, and the mixture was heated to 95° C. for dissolution.

Then, lithium hydroxide in an amount (in terms of solid) shown in Table 5 was added as an aqueous solution and the mixture was heated to 120° C. to evaporate water.

After removal of water, the temperature was further increased to 195 to 205° C., and the resultant was stirred at a rotation speed of 80 to 100 rpm for 1 hour to promote the reaction.

After the completion of the reaction, the same mineral base oil as above was added as a cooling oil, and then cooled to 60° C. through natural cooling. After cooling, in Examples 10 and 12 and Comparative Example 6, dinonyldiphenylamine was added as an antioxidant in an amount shown in Table 5 and the mixture was thoroughly mixed.

Then, the resultant was subjected to a milling treatment with a triple roll mill to thereby obtain grease compositions (G1) to (G4) and (g1) to (g2).

The contents of lithium soaps contained as a thickener in the resulting grease compositions were shown in Table 5. The resulting grease compositions were measured for the worked penetration and were subjected to a thin film oxidation test according to the aforementioned methods. The results are shown together in Table 5.

TABLE 5

| | | | | Example | | Example | | Comparative Example | |
|---|---|---|---|---|---|---|---|---|---|
| | | | | 9 | 10 | 11 | 12 | 5 | 6 |
| | | Grease composition | | (G1 | (G2) | (G3) | (G4) | (g1) | (g2) |
| Composition | Mineral base oil | Mineral base oil (A) from Example 1 | parts by mass | 88.10 | 87.60 | — | — | — | — |
| | | Mineral base oil (B) from Example 2 | | — | — | 88.10 | 87.60 | — | — |
| | | Mineral base oil (C) from Comparative Example 1 | | — | — | — | — | 88.10 | 87.60 |
| | Antioxidant | Dinonyldiphenylamine | parts by mass | — | 0.50 | — | 0.50 | — | 0.50 |
| | Thickener | Raw material: 12-hydroxystearic acid | parts by mass | 10.00 | 10.00 | 10.00 | 10.00 | 10.00 | 10.00 |
| | | Raw material: oleic acid | | 0.50 | 0.50 | 0.50 | 0.50 | 0.50 | 0.50 |
| | | Raw material: lithium hydroxide monohydrate | | 1.40 | 1.40 | 1.40 | 1.40 | 1.40 | 1.40 |
| | | Content of lithium soap | parts by mass | 11.90 | 11.90 | 11.90 | 11.90 | 11.90 | 11.90 |
| | | Total | parts by mass | 100.00 | 100.00 | 100.00 | 100.00 | 100.00 | 100.00 |
| Properties of grease composition | | Worked penetration | — | 285 | 287 | 274 | 277 | 281 | 285 |
| | | Thin film oxidation test Evaporation rate | % | 1.5 | 0.0 | 4.6 | 3.3 | 15.8 | 15.7 |

As shown in the results, the grease compositions (G1) and (G3) prepared in Examples 9 and 11 had superior oxidation stability even without any antioxidant. On the other hand, the grease composition (g1) prepared in Comparative Example 5 had inferior oxidation stability.

According to Examples 10 and 12, the grease compositions (G3) and (G4) prepared by further blending an antioxidant into the grease compositions (G1) and (G2) were further improved in the oxidation stability owing to the incorporation of the antioxidant.

On the other hand, according to Comparative Example 6, the grease composition (g2) prepared by further blending an antioxidant into the grease composition (g1) did not show any substantial effect to improve the oxidation stability.

Examples 13 to 16, Comparative Examples 7 to 8

In a 1 L metal reactor tank, a mineral base oil of a type shown in Table 6 and diphenylmethane-4,4'-diisocyanate (MDI) in an amount shown in Table 6 were added, and dissolved while heating to 70° C. at a rotation speed of 80 to 100 rpm to thereby prepare a solution (1) containing MDI.

Meanwhile, into a 1 L metal vessel separately provided, a mineral base oil of the same type and stearylamine and cyclohexylamine in amounts shown in Table 6 were added, and dissolved while heating to 70° C. at a rotation speed of 80 to 100 rpm to thereby prepare a solution (2) containing stearylamine and cyclohexylamine.

Next, the solution (2) was slowly added into the metal vessel containing the solution (1) at 70° C., and the mixture was stirred for homogenization at a rotation speed of 80 to 100 rpm for 1 hour.

Then, the reaction mixture was heated to 160° C., and kept for 2 hours with intermittent vigorous stirring every 15 minutes for overall homogenization, to thereby promote the reaction.

After the completion of the reaction, the mixture was cooled to 25° C. through natural cooling. After cooling, in Examples 14 and 16 and Comparative Example 8, dinonyldiphenylamine was added in an amount shown in Table 6 as an antioxidant and then was thoroughly mixed.

Then, the resultant was subjected to a milling treatment with a triple roll mill to thereby obtain grease compositions (G5) to (G8) and (g3) to (g4).

The thickener contained in the grease compositions is a urea compound of the general formula (b1) in which one of $R^1$ and $R^2$ is a stearyl group (octadecyl group), the other is a cyclohexyl group, and $R^3$ is a diphenylmethylene group.

The contents of the urea compound contained as a thickener in the resulting grease compositions are shown in Table 6. The resulting grease compositions were measured for the worked penetration and were subjected to the thin film oxidation test according to the aforementioned methods. The results are shown together in Table 6.

TABLE 6

| | | | | Example | | Example | | Comparative Example | |
|---|---|---|---|---|---|---|---|---|---|
| | | | | 13 | 14 | 15 | 16 | 7 | 8 |
| | | Grease Composition | | (G5) | (G6) | (G7) | (G8) | (g3) | (g4) |
| Composition | Mineral base oil | Mineral base oil (A) from Example 1 | parts by mass | 89.96 | 89.46 | — | — | — | — |
| | | Mineral base oil (B) from Example 2 | | — | — | 89.96 | 89.46 | — | — |
| | | Mineral base oil (C) from Comparative Example 1 | | — | — | — | — | 89.96 | 89.46 |
| | Antioxidant | Dinonyldiphenylamine | parts by mass | — | 0.50 | — | 0.50 | — | 0.50 |
| | Thickener | Raw material: MDI | parts by mass | 3.90 | 3.90 | 3.90 | 3.90 | 3.90 | 3.90 |
| | | Raw material: cyclohexylamine | | 1.21 | 1.21 | 1.21 | 1.21 | 1.21 | 1.21 |

TABLE 6-continued

| | | | Example | | Example | | Comparative Example | |
|---|---|---|---|---|---|---|---|---|
| | | | 13 | 14 | 15 | 16 | 7 | 8 |
| | Raw material: stearylamine | | 4.93 | 4.93 | 4.93 | 4.93 | 4.93 | 4.93 |
| | Content of urea compound | parts by mass | 10.04 | 10.04 | 10.04 | 10.04 | 10.04 | 10.04 |
| | Total | parts by mass | 100.00 | 100.00 | 100.00 | 100.00 | 100.00 | 100.00 |
| Properties of grease | Worked penetration | — | 290 | 293 | 272 | 276 | 298 | 302 |
| Composition | Thin film oxidation test Evaporation rate | % | 3.2 | 0.6 | 21.8 | 20.1 | 48.5 | 46.7 |

As shown in the results, the grease composition (G5) and (G7) prepared in Examples 13 and 15 had superior oxidation stability even without any antioxidant. On the other hand, the grease composition (g3) prepared in Comparative Example 7 had inferior oxidation stability.

According to Examples 14 and 16, the grease compositions (G6) and (G8) prepared by further blending an antioxidant into the grease compositions (G5) and (G7) had further improved oxidation stability owing to the incorporation of the antioxidant.

On the other hand, according to Comparative Example 8, the grease composition (g4) prepared by further blending an antioxidant into the grease composition (g3) did not show any substantial effect to improve the oxidation stability.

The invention claimed is:

1. A grease composition, comprising:

a mineral base oil having:

a kinetic viscosity at 100° C. of 7 $mm^2/s$ or more and less than 10 $mm^2/s$;

a viscosity index of 100 or more;

a temperature gradient $\Delta|\eta^*|$ of complex viscosity between two temperature points of −5° C. and −15° C. of 10 to 240 mPa·s/° C. or less as measured with a rotary rheometer at an angular velocity of 6.3 rad/s; and a naphthene content (% $C_N$) of 16 to 30; and a thickener, wherein the grease composition comprises, based on a total mass of the grease composition:

from 70-97% by mass of the mineral base oil; and from 3-30% by mass of the thickener, and wherein the mineral base oil is obtained by refining a feedstock oil comprising a petroleum-derived wax and a bottom oil, and wherein the thickener is one or more selected from a metal soap and a urea compound.

2. The grease composition according to claim 1, wherein the mineral base oil has a complex viscosity $\eta^*$ at −15° C. of 3,000 m·Pas or less as measured with a rotary rheometer at an angular velocity of 6.3 rad/s.

3. The grease composition according to claim 1, wherein the mineral base oil has an aromatic content (% $C_A$) of 0.1 or less and a sulfur content of less than 10 ppm by mass.

4. The grease composition according to claim 1, wherein the feedstock oil has a ratio of the content of the wax to the content of the bottom oil [wax/bottom oil] by mass of 30/70 to 98/2.

5. The grease composition according to claim 1, wherein the thickener comprises a metal soap.

6. The grease composition according to claim 1, wherein the thickener comprises a urea compound.

* * * * *